United States Patent [19]

Attia et al.

[11] Patent Number: 4,512,879

[45] Date of Patent: Apr. 23, 1985

[54] PROCESS FOR PRODUCING A METALLIFEROUS CONCENTRATE FROM A PARTICULATE FEED MATERIAL

[75] Inventors: Yosry A. Attia; Ted L. Tewksbury, both of Columbus, Ohio

[73] Assignee: Battelle Development Corp., Columbus, Ohio

[21] Appl. No.: 515,574

[22] Filed: Jul. 20, 1983

[51] Int. Cl.[3] ..... B03B 1/00

[52] U.S. Cl. ..... 209/3; 209/12; 209/38; 209/39; 209/40; 209/127.2

[58] Field of Search ..... 209/12, 13, 2, 44, 38–40, 209/3, 127 R, 127 A

[56] References Cited

U.S. PATENT DOCUMENTS

| | | | |
|---|---|---|---|
| 9,610 | 3/1853 | Gardiner . | |
| 959,646 | 5/1910 | Swart . | |
| 1,462,584 | 7/1923 | Smith . | |
| 1,679,739 | 8/1928 | Overstrom . | |
| 2,197,865 | 4/1940 | Johnson | 209/12 |
| 2,240,718 | 5/1941 | Schiffman et al. | 209/39 |
| 2,270,526 | 1/1942 | Keyser et al. | 209/127 |
| 2,309,923 | 2/1943 | Robertson | 209/39 |
| 2,388,731 | 11/1945 | Feild | 209/127 |
| 2,604,207 | 7/1952 | Scott | 209/218 |
| 2,737,348 | 3/1956 | Roberts | 241/24 |
| 2,765,074 | 10/1956 | Diamond | 209/3 |
| 2,805,769 | 9/1957 | Lawver | 209/11 |
| 2,988,212 | 6/1961 | Walker | 209/12 |
| 3,337,328 | 8/1967 | Lawver | 75/3 |
| 3,502,271 | 3/1970 | Hays | 209/39 |
| 3,638,791 | 2/1972 | Harrison | 209/12 |
| 3,720,312 | 3/1973 | Shook et al. | 209/130 |
| 3,970,546 | 7/1976 | Webb | 209/3 |
| 4,028,228 | 6/1977 | Ferris et al. | 209/39 |

*Primary Examiner*—Charles Hart

*Attorney, Agent, or Firm*—Sidney W. Millard

[57] ABSTRACT

A concentrate containing precious metals is produced from a particulate feed material containing particles of various sizes by a size fractionation step, a gravity separation step performed on each size fraction separately, a magnetic separation step and a second gravity separation step. The process is especially intended for separating gold and other metals from so-called "black sand" placer deposits.

6 Claims, 3 Drawing Figures

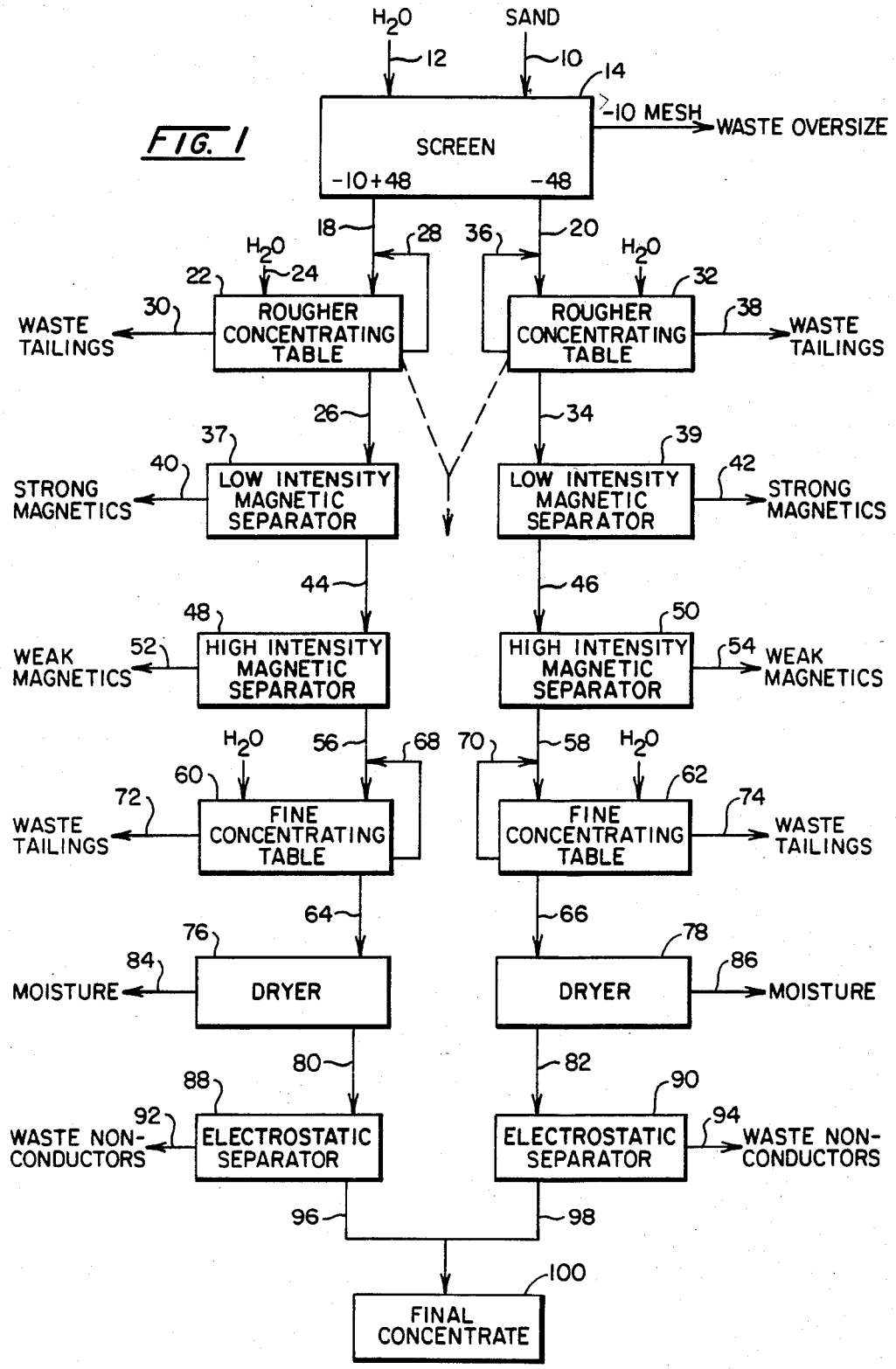
FIG. 1
H2O
SAND
12
10
14
SCREEN
-10+48
-48
>-10 MESH
WASTE OVERSIZE
18
28
36
20
H2O
24
22
30
ROUGHER CONCENTRATING TABLE
WASTE TAILINGS
H2O
32
38
ROUGHER CONCENTRATING TABLE
WASTE TAILINGS
26
34
37
40
LOW INTENSITY MAGNETIC SEPARATOR
STRONG MAGNETICS
39
42
LOW INTENSITY MAGNETIC SEPARATOR
STRONG MAGNETICS
44
46
48
52
HIGH INTENSITY MAGNETIC SEPARATOR
WEAK MAGNETICS
50
54
HIGH INTENSITY MAGNETIC SEPARATOR
WEAK MAGNETICS
H2O
56
68
70
58
H2O
60
72
FINE CONCENTRATING TABLE
WASTE TAILINGS
62
74
FINE CONCENTRATING TABLE
WASTE TAILINGS
64
66
76
84
DRYER
MOISTURE
78
86
DRYER
MOISTURE
80
82
88
92
ELECTROSTATIC SEPARATOR
WASTE NON-CONDUCTORS
90
94
ELECTROSTATIC SEPARATOR
WASTE NON-CONDUCTORS
96
98
100
FINAL CONCENTRATE VIRGIN ORE
102
GRIZZLY
104
WASTE
106
108
A
112
116
WASTE
SCREEN
110
114
118
120
TAILS
(TO POND)
142
140
144
124
HYDROCLONE
128
138
HYDROCLONE
146
122
126
130
132
156
SPIRAL
148
B
MIDDS
& TAILS
(TO POND)
134
C
136
SPIRAL
154
152
MIDDS
& TAILS
(TO POND)
150
D
E
158
162
LIMS
160
MAGNETICS
164
F
168
HIMS
166
MAGNETICS
170
G
174
TABLE
TAILS
MIDDS
(TO POND)
176
178
186
184
188
180
FILTER
TANK
$H_2O$
182
FINAL CONCENTRATES

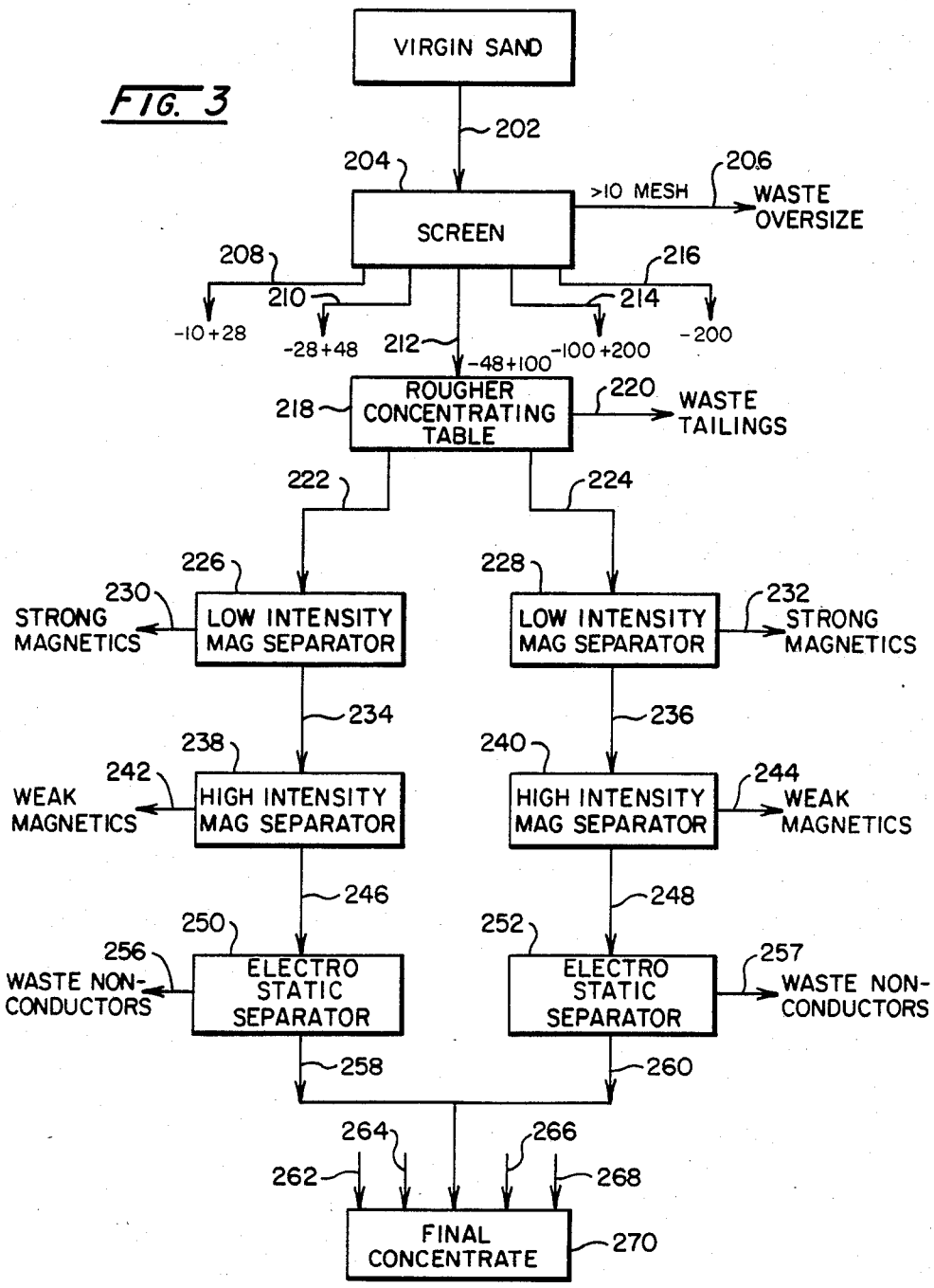
FIG. 3
VIRGIN SAND
202
204
SCREEN
>10 MESH
206
WASTE OVERSIZE
208
210
212
214
216
-10+28
-28+48
-48+100
-100+200
-200
218
ROUGHER CONCENTRATING TABLE
220
WASTE TAILINGS
222
224
226
228
230
STRONG MAGNETICS
LOW INTENSITY MAG SEPARATOR
LOW INTENSITY MAG SEPARATOR
232
STRONG MAGNETICS
234
236
238
240
242
WEAK MAGNETICS
HIGH INTENSITY MAG SEPARATOR
HIGH INTENSITY MAG SEPARATOR
244
WEAK MAGNETICS
246
248
250
252
256
WASTE NON-CONDUCTORS
ELECTRO STATIC SEPARATOR
ELECTRO STATIC SEPARATOR
257
WASTE NON-CONDUCTORS
258
260
264
266
262
268
FINAL CONCENTRATE
270

PROCESS FOR PRODUCING A METALLIFEROUS CONCENTRATE FROM A PARTICULATE FEED MATERIAL

BACKGROUND OF THE INVENTION

This invention relates to a process and apparatus for producing a metalliferous concentrate from a particulate feed material. The term "metalliferous concentrates" is used herein to denote a concentrate which is substantially richer in precious metals (i.e. gold, silver and the six metals of the platinum double triad) than the particulate feed material from which it is derived. The process and the apparatus of the invention are especially intended for treating particulate feed material containing particles of various sizes, and are particularly intended for use in producing an auriferous concentrate from a particulate feed material containing low concentrations of gold, of the order of 0.1 oz. per short ton of feed material.

Gold is often found in so-called placer deposits, that is deposits which have been formed by stream action over long periods, perhaps millions of years. Such placer deposits comprise mixtures of sand, gravel and boulders, with the gold (and sometimes other precious metals) being present in the form of very fine particles mixed with the sand and gravel. Because the placer material has been deposited by stream action over a very long period, there is a tendency for the heavier particles, including the gold, to concentrate at certain levels and in discrete areas rather than to be distributed uniformly throughout the deposit. Placer deposits typically contain an average of about 10% of magnetite ($Fe_3O_4$), a relatively dense (specific gravity about 5), dark colored granular material known as "black sand". Because both the magnetite and the gold are considerably denser than other constituents of the placer deposits, the magnetite or black sand tends to separate along with the gold particles both in situ in the placer deposit and during processing by simple gravity separation.

The extraction of gold from placer deposits presents great difficulties. The concentration of gold in the placer deposit is usually low, typically of the order of 0.03–0.2 oz/per ton, and the gold is distributed in a highly non-uniform manner because of the heterogenous nature of the placer deposits so that it is difficult and expensive to obtain samples and assays that are reasonably representative of the entire deposit. Furthermore, investigations have revealed that present day commercial processes for extracting gold from placer deposits frequently discard a significant proportion of the gold in the deposits, usually in the black tailings produced during processing. Because the gold concentration in the deposits is so low, it is necessary to produce from the deposits a metalliferous concentrate greatly enriched in gold and any other precious metals which are present; this metalliferous concentrate can then be subjected to further chemical processing familiar to those skilled in the art to extract the precious metals. Moreover, whatever process is adopted for producing the metalliferous concentrate must be able to handle large quantities of feed material cheaply; assuming a gold price around U.S. $400 per ounce, and allowing for the costs of further refining of the concentrate, we estimate that typical placer deposits can only be economically mined if the processing costs do not exceed about $5–6 per ton of placer deposit material.

This invention seeks to provide a process for producing a metalliferous concentrate from a particulate feed material which can be economically applied to a typical placer deposit.

SUMMARY OF THE INVENTION

This invention provides a process for producing a metalliferous concentrate from a particulate feed material containing particles of varying sizes, this process comprising:

(a) separating the feed material into a first fraction containing large particles and a second fraction containing smaller particles;

(b) subjecting these first and second particles separately to a first gravity separation step, thereby producing from each of the first and second fractions a denser fraction and a lighter fraction; and (c) subjecting the denser fractions to magnetic separation, thereby producing at least one non-magnetic fraction to form the metalliferous concentrate and at least one magnetic fraction.

In a preferred embodiment of this process, the particulate feed material is black sand, which is subjected to a preliminary separation step in which only particles smaller than about 10 mesh are retained, and the magnetic separation step comprises a low-intensity magnetic separation step followed by a high-intensity magnetic separation step.

This invention also provides apparatus for producing a metalliferous concentrate from a particulate feed material containing particles of varying sizes, this apparatus comprising:

size separating means for separating the feed material into at least two fractions differing in particle size;

first gravity separating means which receive the fractions from the size separating means and subject each of these fractions separately to gravity separation, thereby producing from each of the fractions a denser fraction and a lighter fraction; and magnetic separation means which receive the denser fractions from the first separating means and subject them to magnetic separation, thereby producing at least one non-magnetic fraction to form the metalliferous concentrate and at least one magnetic fraction.

BRIEF DESCRIPTION OF THE DRAWINGS

FIG. 1 is a flow diagram showing schematically a first process of the invention;

FIG. 3 is a diagram showing schematically a third process of the invention.

DETAILED DESCRIPTION OF THE INVENTION

Figure 2:
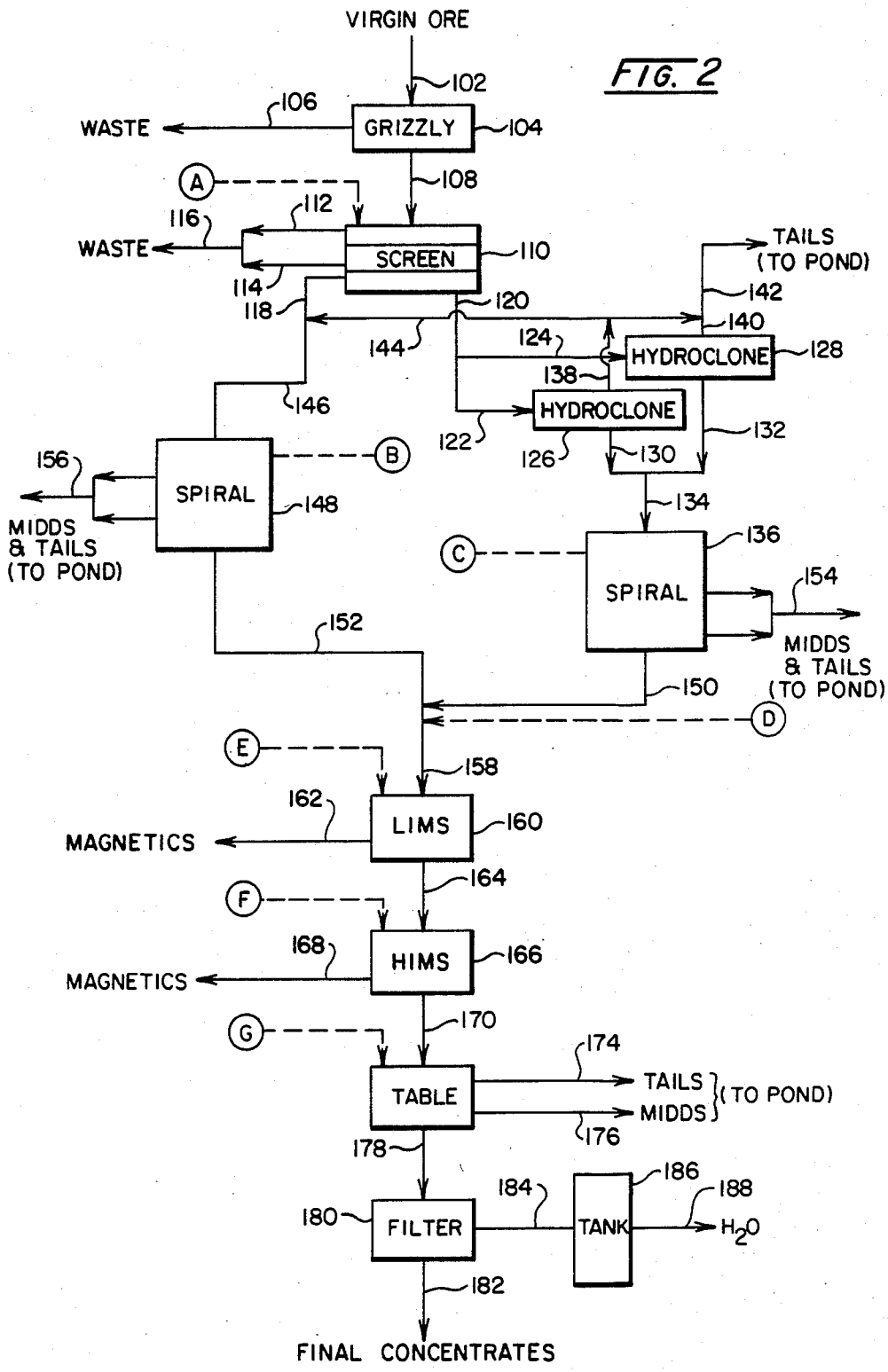
FIG. 2 is a flow diagram showing schematically a second process of the invention.

The individual steps in the instant process, and appropriate, commercially-available forms of apparatus for carrying out the individual steps, are known to those skilled in the art. Accordingly, it is not considered necessary to describe the individual components used in the instant apparatus in great detail.

In the first step of the instant process, the feed material is divided into at least two fractions, these fractions differing from one another in particle size. Advantageously, this first step includes a preliminary separation step in which only particles smaller than about 10 mesh are retained; this preliminary separation discards the large gravel, stones and boulders which are usually present in large quantities in gold and other precious metal deposits. Such large gravel, stones and boulders contain essentially no precious metal and thus the preliminary separation step greatly reduces the quantities of material which have to be handled by the instant process. The preliminary separation step is conveniently effected using a grizzly, an apparatus comprising a bed of spaced parallel bars. When the feed material being processed is a placer deposit, it will normally be necessary to truck the material being processed to the processing plant, and in these circumstances it is most convenient to use a grizzly mounted upon the truck, since typically only about 50% by weight of the material will pass through the grizzly, and thus using a truck-mounted grizzly reduces by about half the quantity of material which has to be transported to the processing plant.

As already mentioned, the first step, step (a), of the instant process divides the feed material into at least two fractions differing from one another in particle size. The embodiments of the invention described below with reference to FIGS. 1 and 2 both, in their first steps, divide the feed material into fractions of 10–48 mesh and less than 48 mesh, but the invention is not restricted to processes in which the first step produces only two fractions; indeed, especially in a large-scale processing plant, it will normally be advantageous for the first step of the instant process to divide the feed material into more than two size fractions. For example, in a large scale plant, it might be convenient to use four fractions having particle sizes of 10–20 mesh, 20–48 mesh, 48–100 mesh and less than 100 mesh respectively. Alternatively, as in the embodiment of the invention shown in FIG. 3 and described below, one might use five fractions having particle sizes of 10–28 mesh, 28–48 mesh, 48–100 mesh, 100–200 mesh and less than 200 mesh respectively. When operating the instant process, care should be taken to lose as little as possible of the less than 200 mesh material, since our research indicates that loss of such fines is one of the greatest sources of loss of gold in prior art processes for mining placer deposits.

Step (b) of the instant process, the first gravity separation step, is preferably effected using either a concentrating table or a spiral concentrator. As those skilled in the art are aware, a concentrating table comprises a table which slopes both longitudinally and transversely and which is equipped with a vibrator. Particles enter the table at its highest point and the combination of the slope and the vibration on the table causes the lighter and denser particles to leave the table at different edges. In a spiral concentrator, a liquid slurry (normally, of course an aqueous slurry) containing the material to be separated flows down a helical ramp which slopes downwardly towards its axis; the denser particles tend to concentrate adjacent the axis of the ramp.

It is believed (although the invention is in no way limited by this belief) that the size separation effected in the first step of the instant process renders the first gravity separation step more efficient in that gravity separation techniques are more effective where all the particles being separated are of similar sizes. Depending upon the amount of denser fraction produced in step (b) of the instant process and the capacity of the apparatus used in the later steps, it may be convenient to combine the denser fractions formed in step (b) before further processing of these fractions; however, the inventions extend to a process in which the plurality of denser fractions generated in step (b) are kept separate throughout the remaining steps of the process.

Step (c) of the instant process, the magnetic separation step, preferably comprises a low-intensity magnetic separation step followed by a high-intensity magnetic separation step. The low-intensity magnetic separation step produces a strongly magnetic fraction, comprising chiefly magnetite and other strongly magnetic materials, and a low-intensity non-magnetic fraction; only the latter fraction is passed to the subsequent high-intensity magnetic separation step, while the strongly magnetic fraction is either discarded or recycled for further processing. The high-intensity magnetic separation step produces a non-magnetic fraction which, with or without further processing, forms the metalliferous concentrate, and a weakly magnetic fraction, comprising chiefly hematite and similar materials, which is either discarded or recycled for further processing. Both the low- and high-intensity magnetic separation steps are conveniently effected in conventional slurry-type magnetic separators in which a slurry of the material being processed is carried by a rotating drum past a fixed magnet so that the more magnetic material in the slurry is drawn towards the magnet. Typically, the low-intensity magnetic separator will operate with a field of about 1000 Gauss, while the high-intensity magnetic separator will operate with a field of about 6,000 Gauss.

The non-magnetic fraction produced by the magnetic separation step of the instant process may itself comprise the metalliferous concentrate; if the magnetic separation step is performed on a slurry of the material being separated, it will of course normally be necessary to dewater the non-magnetic product fraction to produce a relatively dry concentrate. However, to effect further concentration of precious metals, it is desirable to subject the non-magnetic fraction produced in the magnetic seperation step of the instant process to a second gravity separation step and/or an electrostatic separation step. If a second gravity separation step is employed, this gravity separation is preferably effected using a concentrating table.

As those skilled in the art are aware, commercially-available electrostatic separators comprise a rotating drum having a high-tension wire running therethrough. The more conductive material within the drum is drawn towards the wire, and a baffle or "splitter" separates the conductive product from the less conductive fraction.

Either the second gravity separation step or the electrostatic separation step may be employed alone, or a combination of the two steps may be employed. However, for obvious reasons, electrostatic separators cannot operate on very wet material. Thus, if the magnetic separation step of the instant process is performed on a slurry and it is desired to use both a gravity separation step and an electrostatic separation step, it will normally be more convenient to effect the second gravity separation step on the slurry from the magnetic separation step and then dewater the slurry to produce a relatively dry material suitable for the electrostatic separation step. In an case, whether the feed to the electrostatic separation step comes from the magnetic separation step or from the second gravity separation step, if the feed to the electrostatic separation step is in a slurry or very wet form it will be necessary to dewater the slurry or very wet material before passing it to the electrostatic separator.

As already indicated, the feed material used in the instant process may be auriferous placer deposits directly as mined, although it is anticipated that the instant process may also be applicable to many other types of feed material containing precious metals. However, it should be noted that the instant process is useful for further processing of black sand tailings discarded during conventional processing of auriferous placer deposits, since it has been found that these black sand tailings do contain useful concentration of precious metals which are not recovered by conventional extraction processes.

In the preferred embodiment of the invention shown in FIG. 1, a stream of black sand tailings 10 is admixed with a stream of water 12 and fed to a screening apparatus 14 containing 10 and 48 mesh screens, which serve to divide the black sand tailings 10 into three fractions, namely a greater than 10 mesh fraction, which is discarded as oversized, a 10–48 mesh fraction 18 and a below 48 mesh fraction 20. The 10–48 mesh fraction 18 is fed to a rougher concentrating table 22, which is supplied with additional water via a water inlet 24. The table 22 effects gravity separation of the fraction 18 producing a denser fraction 26, which is passed for further treatment, a middle fraction 28, which is recycled after mixing with the incoming fraction 18, and a lighter fraction 30 which is discarded as waste tailings. The below 48 mesh fraction 20 is fed to a separate rougher concentrating table 32, which operates in a manner exactly parallel to the table 22, producing a denser fraction 34, which is passed for further processing, a middle fraction 36, which is recycled, and a ligher fraction 38 which is discarded as waste tailings.

If desired, the denser fractions 26 and 34 produced by the tables 22 and 32 respectively can be combined for further processing, as indicated by the broken lines in FIG. 1. However, in the apparatus shown in FIG. 1, these denser fractions 26 and 34 are fed to separate low-intensity magnetic separators 37 and 39 respectively. These low intensity magnetic separators 37 and 39 each produce a strongly magnetic fraction 40 or 42 respectively, which comprises mainly magnetite and which is discarded, and a low-intensity non-magnetic fraction 44 or 46 respectively. The low-intensity non-magnetic fractions 44 and 46 are fed to separate high-intensity magnetic separators 48 and 50 respectively. The high-intensity magnetic separators 48 and 50 each produce a weakly magnetic fraction 52 or 54 respectively, which comprises mainly hematite and which is discarded as waste, and a non-magnetic fraction 56 or 58 respectively.

The non-magnetic fractions 56 and 58 are passed to separate fine concentrating tables 60 and 62 respectively; these tables 60 and 62 operate in a manner exactly similar to the rougher concentrating tables 22 and 32 respectively, effecting gravity separation of the non-magnetic fractions 56 and 58 respectively to produce denser fractions 64 and 66 respectively, which are passed for further processing, middle fractions 68 and 70 respectively, which are recycled and admixed with the incoming fractions 56 and 58 respectively, and lighter fractions 72 and 74 respectively which are discarded as waste. The denser fractions 64 and 66 are passed from the table 60 and 62 respectively to separate dryers 76 and 78 respectively, which effect dewatering to produce dried fractions 80 and 82 respectively, the water in the incoming material being discarded as indicated schematically at 84 and 86. The dried fractions 80 and 82 are then passed to separate electrostatic separators 88 and 90, which produce non-conductive fractions 92 and 94 respectively, these non-conductive fractions being discarded as waste, and conductive fractions 96 and 98 respectively, which are combined to form the final metalliferous concentrate 100.

The apparatus shown schematically in FIG. 1 is intended to process 2,500 pounds (1134 kg.) per hour of black sand tailings 10 using three times that amount of water in the stream 12. Water usage is approximately 31 gallons (117 liters) per minute and electrical requirements amount to about 15 kw. The amounts of material in the various streams during a typical processing operation are as shown in Table I below (no metric conversions are provided since obviously only the relative amounts of material in the various streams of are consequence).

TABLE I

| Fraction No. | Pounds of Material per Hour |
|---|---|
| 16 | 870 |
| 18 | 888 |
| 20 | 743 |
| 26 | 136 |
| 30 | 752 |
| 34 | 114 |
| 38 | 629 |
| 40 | 98 |
| 42 | 82 |
| 44 | 38 |
| 46 | 32 |
| 52 | 20 |
| 54 | 17 |
| 56 | 18 |
| 56 | 15 |
| 64 | 16.2 |
| 66 | 13.5 |
| 72 | 1.8 |
| 74 | 1.5 |
| 80 | 16.2 |
| 82 | 13.5 |
| 92 | 15.5 |
| 94 | 13 |
| 96 | 0.7 |
| 98 | 0.5 |
| 100 | 1.2 |

(The figures in the above table of course represent pounds of solids per hour.)

If operating with a feed material containing approximately 0.1 oz. of gold per ton, the apparatus shown schematically in FIG. 1 should be able to recover better than 90% of the gold in the final concentrate.

In the apparatus shown in FIG. 2, a stream of virgin ore 102 is fed to a grizzly 104 which separates out the material having a particle size greater than 2 inches (5 cm.) as waste 106, while the material having a particle size below 2 inches (5 cm.) is passed as a feed 108 to a screen assembly 110. This screen assembly comprises three screens of 2, 10 and 48 mesh respectively, which are fed not only with the feed stream of ore 108 but also with a stream of water from a source A. The 2 mesh screen separates out a stream 112 of large waste having a particle size greater than one half inch (12.7 mm.), while the 10 mesh screen separates out a stream of small waste 114 having a particle size greater than 0.1 inch (2.5 mm.). The waste streams 112 and 114 are, as shown in FIG. 2, combined into a waste stream 116 for disposal.

The screen assembly 112 divides the useful (i.e. less than 10 mesh) portion of the incoming feed stream 108 into a 10–48 mesh stream 118 and a below 48 mesh stream 120. The latter stream 120 is divided into two equal streams 122 and 124 which are passed to separate hydroclones 126 and 128 respectively. As those skilled in the art are aware, hydroclones are a commercially-available form of centrifugal liquid-solid separators. Each hydroclone divides the incoming slurry 122 or 124 into a solid-rich fraction and a liquid-rich fraction. The solid-rich fractions 130 and 132 from the hydroclones 126 and 128 respectively are combined to form a stream 134 which is fed to a spiral concentrator 136. On the other hand, the liquid-rich fractions 138 and 140 from the hydroclones 126 and 128 respectively are combined and then redivided into a major stream 142, which is sent as tailings to a pond, and a minor stream 144 which is combined with the stream 118 in order to increase the proportion of liquid therein. The stream 146 formed by combining streams 118 and 144 is then sent to a spiral concentrator 148.

Both spiral concentrators 136 and 148 operate in the same manner, the only difference being, of course, that the size of the solid particles in the slurries upon which they operate is different. The incoming stream 134 or 146 respectively is combined with a supply of water (C or B respectively) and the resultant mixture then separated into three different fractions, namely a product fraction 150 or 152 respectively, and two waste fractions which are combined to form waste streams 154 and 156 respectively. These waste streams 154 and 156 are both sent to the aforementioned pond.

The product streams 150 and 152 are combined with one another and with water from a source D to form a diluted combined product stream 158, which is then passed, together with further water from a source E, to a low-intensity magnetic separator 160. This low-intensity magnetic separator 160 operates in a manner similar to the low-intensity magnetic separators 37 and 39 described above with reference to FIG. 1, dividing the stream 158 into a strongly magnetic fraction 162, which is discarded on a stockpile, and a low-intensity non-magnetic fraction 164. This low-intensity non-magnetic fraction 164 is fed, together with further water from a source F, to a high-intensity magnetic separator 166, which operates in a manner similar to the high-intensity magnetic separators 48 and 50 described above with reference to FIG. 1, and divides the incoming stream 164 into a weakly magnetic fraction 168, which is discarded on the same stockpile as the strongly magnetic fraction 162, and a non-magnetic fraction 170.

The non-magnetic fraction 170 is passed, together with water from a source G, to a concentrating table, which functions is a manner similar to that of the fine concentrating tables 60 and 62 described above with reference to FIG. 1, except that the middlings are not recycled; instead, the table produces a tailings stream 174 and a middlings stream 176, both of which are discarded to the aforementioned pond. The table also, of course, produces a product stream 178, which is passed to a filter 180, which dewaters the product stream 178 to produce a stream 182 of final concentrate and a liquid-rich stream 184, which is passed via a settling tank 186 to form a waste water stream 188. This waste water stream 188 is then discarded to the aforementioned pond.

A material flow table for the apparatus shown in FIG. 2 is given in Table 2 below:

TABLE 2

| Stream # | Solids, TPH | Liquid, TPH | Pulp, TPH | Solids, wt. % | Pulp, Sp. Gr. | Solids, USGPM | Liquid, USGPM | Pulp, USGPM | Solids, vol. % |
|---|---|---|---|---|---|---|---|---|---|
| 102 | 10 | — | — | 100 | — | 14.8 | — | — | — |
| 106 | 3 | — | — | 100 | — | 4.4 | — | — | — |
| 108 | 7 | — | — | 100 | — | 10.4 | — | — | — |
| 112 | 1 | 0.187 | 1.187 | 84.2 | 2.13 | 1.48 | 0.75 | 2.23 | 66.4 |
| 114 | 1 | 0.187 | 1.187 | 84.2 | 2.13 | 1.48 | 0.75 | 2.23 | 66.4 |
| 118 | 2.48 | 0.45 | 2.93 | 84.6 | 2.14 | 3.67 | 1.8 | 5.47 | 67.1 |
| 120 | 2.5 | 44.8 | 47.3 | 5.3 | 1.03 | 3.7 | 179.2 | 182.9 | 2.02 |
| 122 | 1.25 | 22.4 | 23.65 | 5.3 | 1.03 | 1.85 | 89.6 | 91.45 | 2.02 |
| 124 | 1.25 | 22.4 | 23.65 | 5.3 | 1.03 | 1.85 | 89.6 | 91.45 | 2.02 |
| 134 | 2.25 | 3.38 | 5.63 | 40.0 | 1.34 | 3.3 | 13.5 | 16.8 | 19.6 |
| 142 | 0.23 | 38.1 | 38.33 | 0.6 | 1.01 | 0.34 | 152.5 | 152.84 | 0.22 |
| 144 | 0.02 | 3.30 | 3.32 | 0.6 | 1.01 | 0.03 | 13.2 | 13.23 | 0.22 |
| 146 | 2.5 | 3.75 | 6.25 | 40 | 1.34 | 3.7 | 15.0 | 18.7 | 19.8 |
| 150 | 0.225 | 0.15 | 0.375 | 60.0 | 1.61 | 0.33 | 0.60 | 0.93 | 35.5 |
| 152 | 0.25 | 0.17 | 0.42 | 60.0 | 1.62 | 0.37 | 0.69 | 1.04 | 35.6 |
| 154 + 156 | 4.275 | 10.23 | 14.51 | 29.5 | 1.23 | 6.33 | 40.92 | 47.25 | 13.4 |
| 158 | 0.475 | 1.9 | 2.38 | 20.0 | 1.15 | 0.7 | 7.6 | 8.3 | 8.4 |
| 162 | 0.237 | 4.50 | 4.74 | 5.0 | 1.03 | 0.35 | 18.0 | 18.35 | 1.91 |
| 164 | 0.238 | 0.95 | 1.19 | 20.0 | 1.15 | 0.35 | 3.8 | 4.15 | 8.43 |
| 168 | 0.178 | 3.38 | 3.56 | 5.0 | 1.04 | 0.26 | 13.5 | 13.76 | 1.89 |
| 170 | 0.06 | 0.54 | 0.6 | 10.0 | 1.07 | 0.09 | 2.16 | 2.25 | 4.0 |
| 174 | 0.039 | 2.37 | 2.409 | 1.6 | 1.012 | 0.058 | 9.46 | 9.518 | 0.6 |
| 176 | 0.015 | 0.285 | 0.30 | 5.0 | 1.033 | 0.022 | 1.14 | 1.162 | 1.89 |
| 178 | 0.006 | 0.12 | 0.126 | 5.0 | 1.05 | 0.009 | 0.48 | 0.48 | 1.9 |
| 182 | 0.006 | 0.001 | 0.007 | 90.0 | 2.33 | 0.009 | 0.003 | 0.012 | 75 |
| 184 | — | 0.12 | — | — | — | — | 0.49 | — | — |
| 188 | — | 0.12 | — | — | — | — | 0.49 | — | — |
| A | — | 45.63 | — | — | 1.0 | — | 182.5 | — | — |
| B | — | 1.68 | — | — | 1.0 | — | 6.7 | — | — |
| C | — | 1.75 | — | — | 1.0 | — | 7.0 | — | — |
| D | — | 1.58 | — | — | 1.0 | — | 6.33 | — | — |
| E | — | 3.55 | — | — | 1.0 | — | 14.2 | — | — |
| F | — | 2.98 | — | — | 1.0 | — | 11.9 | — | — |
| G | — | 2.23 | — | — | 1.0 | — | 8.92 | — | — |

Note:
Solids, Sp. Gr. = 2.7
Liquid, Sp. Gr. = 1.0

In the third apparatus of the invention shown in FIG. 3, a stream of virgin sand 202 is fed to a screen assembly 204 comprising screens of 10, 28, 48, 100 and 200 mesh respectively. The 10 mesh screen separates out a stream 206 of waste which is discarded. The remaining screens of the screen assembly 204 produce five separate fractions 208, 210, 212, 214 and 216 having particle sizes of 10–28 mesh, 28–48 mesh, 48–100 mesh, 100–200 mesh and less than 200 respectively. For clarity, only the further processing of stream 212 is shown in FIG. 3; however, each of the other streams 208, 210, 214 and 216 is treated separately in precisely the same manner. It should be noted that, in contrast to the apparatus shown in FIGS. 1 and 2, the screen assembly 204 operates on dry material.

The stream 212 leaving the stream assembly 204 passes to a rougher concentrating table 218 which functions in substantially the same manner as the concentrating tables 22 and 32 shown in FIG. 1, except that no recycling of middlings was affected. The concentrating table used was a Deister Laboratory-scale table. Three streams were taken from the table 218, namely a stream 220 of waste tailings which were discarded, a stream 222 of middlings and a stream 224 of high-density material.

The streams 222 and 224 are fed to separate low-intensity magnetic separators 226 and 228 respectively; these low-intensity magnetic separators, which are Carpco rotating field magnetic separators fed at a rate of 10 to 100 g/minute, operate in a manner similar to the low-intensity magnetic separators 37 and 39 shown in FIG. 1, producing waste streams 230 and 232 of strongly magnetic material, which is discarded, and low-intensity non-magnetic fractions 234 and 236 respectively. These low-intensity non-magnetic fractions 234 and 236 are fed to separate high-intensity magnetic separator 238 and 240 respectively, which are induced roll magnetic separators. The high-intensity magnetic separators 238 and 240 operate in a manner generally similar to the magnetic separators 48 and 50 shown in FIG. 1, producing waste streams 242 and 244 respectively of weakly magnetic material which is discarded, and streams 246 and 248 respectively of non-magnetic material. These streams 246 and 248 of non-magnetic material are fed to separate electrostatic separators 250 and 252 respectively. The electrostatic separators 250 and 252 are Carpco electrostatic separators and are operated at a drum speed of 100 rpm. with the electrode at 50°, ¾ of an inch (19 mm.) from the drum using a heater and a vibrating feeder and a feed rate of 25–62 g/minute. The electrostatic separators produce waste streams 256 and 257 respectively of non-conducted material and product streams 258 and 260 respectively. The product stream 260 is then combined with four other similar streams 262, 264, 266, and 268 derived from the other side fractions 208, 210, 214 and 216 respectively to form the final concentrate 270.

The process shown in FIG. 3 was applied to a sample batch of 90.5 pounds (41 kg.) of virgin black sand with the results shown in Table 3 below.

TABLE 3

| Stream No. | Weight, percent | Gold Assay, Troy Ounce/Ton | Gold Distribution, percent |
|---|---|---|---|
| 220 | 90.36 | <0.005 | 0.0 |
| 230 | 2.60 | <0.005 | 0.0 |
| 232 | 1.75 | <0.005 | 0.0 |
| 242 | 1.68 | <0.005 | 0.0 |
| 244 | 0.92 | 0.0013 | 0.1 |
| 256 | 1.78 | <0.005 | 0.0 |
| 257 | 0.62 | 0.0025 | 0.2 |
| 258 | 0.28 | 0.0760 | 3.0 |
| 260 | 0.01 | 68.922 | 96.7 |
| HEAD Calculated | 100.0 | 0.00713 | 100.0 |

The stream 260 assayed approximately 69 troy ounces/ton of gold with a gold recovery of 97%. Although the product stream 258 was produced, it will be seen that this intended product stream in fact only contained 3% of the gold, although it amounted to 28 times the weight of the product stream 260; accordingly, it appears doubtful whether the further processing of the middlings from the rougher concentrating table 218 is worthwhile. The concentration ratio for the stream 260 was 9714, which was very high. The magnetic separators removed 72% of the main material present in the incoming material.

It will be apparent to those skilled in the art that numerous changes and improvements can be made in the preferred embodiments of the invention described above without departing from the scope of the invention. Accordingly, the whole of the foregoing description is to be construed in an illustrative and not in a limitative sense, the scope of the invention being defined solely by the appended claims.

We claim:

1. A process for producing a metalliferous concentrate from particles of varying sizes, said process comprising:
   - subjecting said particles to a preliminary separation step in which only particles smaller than about 10 mesh are retained;
   - dividing said retained particles into a first fraction containing large particles and a second fraction containing smaller particles;
   - subjecting said first and second fractions separately to a first gravity separation step, thereby producing from each of said first and second fractions a denser fraction and a lighter fraction;
   - subjecting said denser fractions to a low-intensity magnetic separation step producing at least one low-intensity non-magnetic fraction and at least one strongly magnetic fraction;
   - subjecting said at least one low-intensity non-magnetic fraction to a high-intensity magnetic separation step, thereby producing at least one non-magnetic fraction and a weakly magnetic fraction; and
   - subjecting said at least one non-magnetic fraction to a second gravity separation step, thereby separating a denser fraction to form said metalliferous concentrate.

2. A process according to claim 1 wherein said feed material comprises black sand containing gold.

3. A process according to claim 1 wherein said denser fraction formed in said second gravity separation step is thereafter subjected to electrostatic separation and is thereby separated into a conductive fraction, which forms said metalliferous concentrate, and a relatively non-conductive fraction.

4. A process according to claim 3 wherein said feed material comprises black sand containing gold.

5. A process according to claim 3 wherein said process is conducted with the fractions to be processed slurried in water and wherein said denser fraction is dewatered before being subjected to said electrostatic separation.

6. A process according to claim 5 wherein said feed material comprises black sand containing gold.

* * * * *